US006431619B1

(12) United States Patent
Fisher et al.

(10) Patent No.: US 6,431,619 B1
(45) Date of Patent: Aug. 13, 2002

(54) DOOR MECHANISM

(75) Inventors: Sydney Edward Fisher, Shirley Solihull (GB); Philippe Ottolini, La Voivre (FR)

(73) Assignee: Meritor Light Vehicle Systems (UK) Limited (GB)

( * ) Notice: Subject to any disclaimer, the term of this patent is extended or adjusted under 35 U.S.C. 154(b) by 0 days.

(21) Appl. No.: 09/744,166

(22) PCT Filed: Jul. 19, 1999

(86) PCT No.: PCT/GB99/02309

§ 371 (c)(1),
(2), (4) Date: Mar. 12, 2001

(87) PCT Pub. No.: WO00/05469

PCT Pub. Date: Feb. 3, 2000

(30) Foreign Application Priority Data

Jul. 20, 1998 (GB) ..... 9815765

(51) Int. Cl.[7] ..... E05C 3/06
(52) U.S. Cl. ..... 292/216; 292/DIG. 23
(58) Field of Search ..... 292/216, DIG. 23, 292/201

(56) References Cited

U.S. PATENT DOCUMENTS 5,653,484 A 8/1997 Brackmann et al.

FOREIGN PATENT DOCUMENTS

| | | |
|---|---|---|
| DE | 1068127 | 10/1959 |
| DE | 19533198 | 3/1997 |
| EP | 0169664 | 1/1986 |
| EP | 0632178 | 1/1995 |
| EP | 0879930 | 5/1998 |

*Primary Examiner*—Teri Pham Luu
(74) *Attorney, Agent, or Firm*—Carlson Gaskey & Olds

(57) ABSTRACT

A door mechanism including self-acting latching means operatively holding the door closed and including a latch release member selectively moveable from a neutral position to a release position freeing the door for opening. Locking means act to secure the latched door by preventing release actuation of the latching means and including a lock drive member selectively moveable between locked and unlocked positions. The latch release member has a path of travel extending between said release position and a door secure position, said neutral position being in an intermediate part of said path. The release member and the lock drive member are coupled by motion transmitting means including a first formation on one of said members co-acting via a connecting means with a second formation on the other of said members to shift the lock drive member to the locked position on movement of the release member from its neutral position to its door secure position.

13 Claims, 4 Drawing Sheets

DOOR MECHANISM

BACKGROUND OF THE INVENTION

This invention relates to latching and locking mechanisms for doors of passenger vehicles.

Vehicle doors are commonly provided with interior and exterior door handles operable from the inside or the outside of the vehicle respectively to release latching means of the door for opening it. Provisions are also made for locking the door to resist unauthorised access by locking means acting to disable or block the latch mechanism to prevent the door being freed when closed. Even if the locking means is power operable, for example as part of a central door locking system, provisions will be made on at least some of the doors for manual locking and unlocking at least from the vehicle interior is. This commonly provided by a manual push-pull button or the like, typically a cill button, separate from the interior door handle which adds to the cost and complication of the door mechanism, and may also involve additional costs in terms of layout to suit the mechanism to particular styles of door, and in terms of making the mechanism tamper-resistant for effectively deterring attempted theft of the vehicle or its contents.

SUMMARY OF THE INVENTION

According to the invention there is provided a vehicle door mechanism including self-acting latching means operatively holding the door closed and including a latch release member selectively moveable from a neutral position to a release position freeing the door for opening. The mechanism further includes locking means acting to secure the latched door by preventing release actuation of the latching means and including a lock drive member selectively movable between locked and unlocked positions. The latch release member has a path of travel extending between the release position and a door secure position, said neutral position being in an intermediate part of the path. The release member and the lock drive member are coupled by motion transmitting means including a first formation on one of the members co-acting via a connecting means with a second formation on the other of the members to shift the lock drive member to the locked position on movement of the release member from its neutral position to its door secure position. Preferably the connecting means is one or both of a link or a resilient connection.

Preferably where a resilient connection is provided, the resilient connection acts in compression and is arranged to reach a state of maximum compression during at least part of the operation of the locking mechanism. The resilient means can be a spring.

Preferably the spring is a helically wound spring that becomes coil bound during at least part of the operation of locking the mechanism.

Preferably resilient means acts between the members to ensure the lock drive member returns to its unlocked position on return movement of the release member from the door secure position to or beyond the neutral position. The resilient means permits travel of the release member to its release position but urging or contributing to the urging of the member from that position to the neutral position.

Conveniently either or both of the latch release and lock drive members are bell crank or other levers which may be fulcrumed about separate parallel axes or, possibly, fulcrumed for movement about a common axis.

The latch release member will typically be connected by a linkage to an interior handle of the door so that the latter serves both to open the door and for its locking and unlocking.

Embodiments of the invention are now more particularly described by way of example and with reference to the accompanying drawings, wherein;

DETAILED DESCRIPTION OF THE PREFERRED EMBODIMENT

Figure 1:
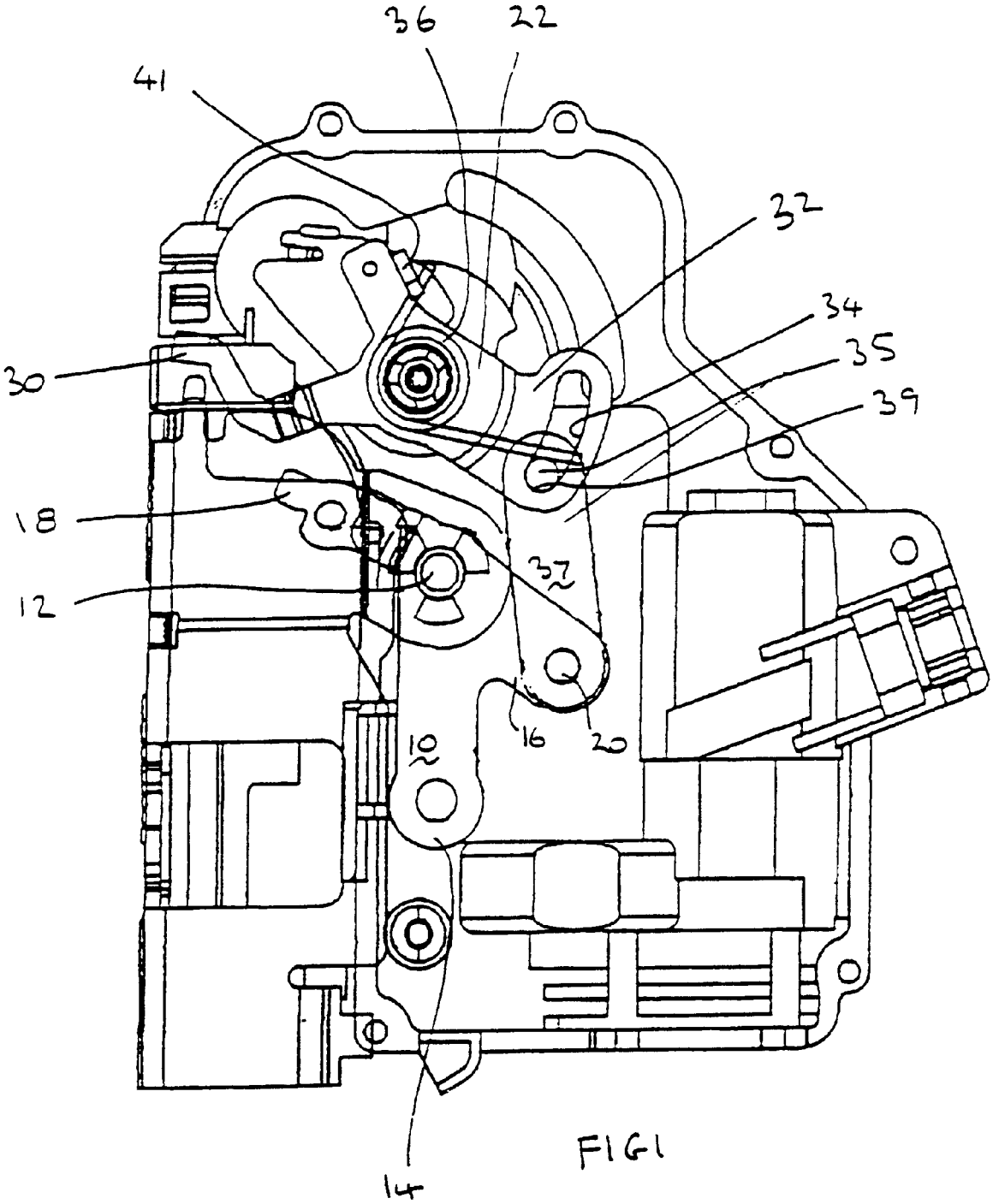
FIG. 1 illustrates a side elevation of a first embodiment of the mechanism of the present invention in a locked/latched condition.
Figure 2:
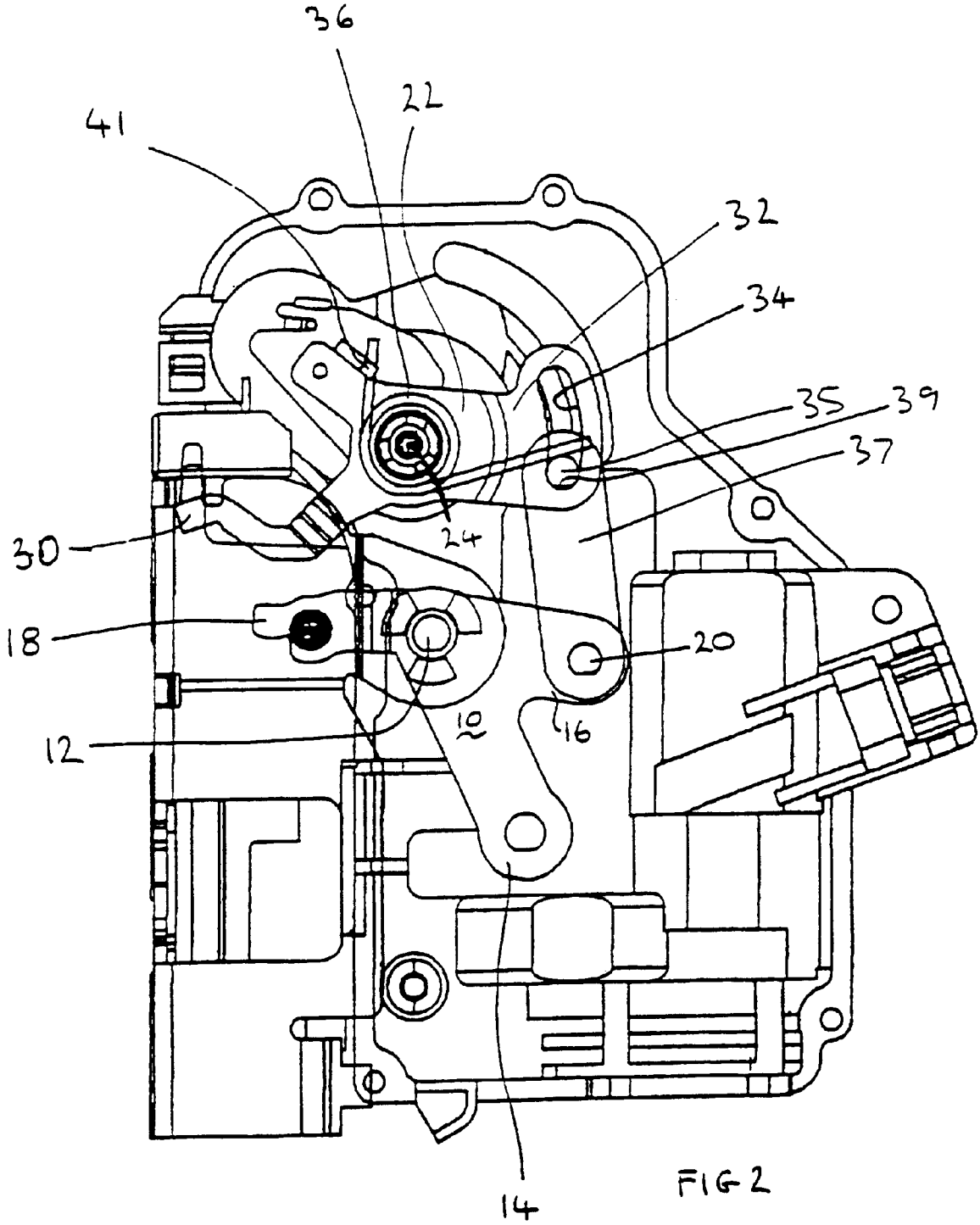
FIG. 2 illustrates a side elevation of a first embodiment of the mechanism of the present invention in an unlocked/latched condition.
Figure 3:
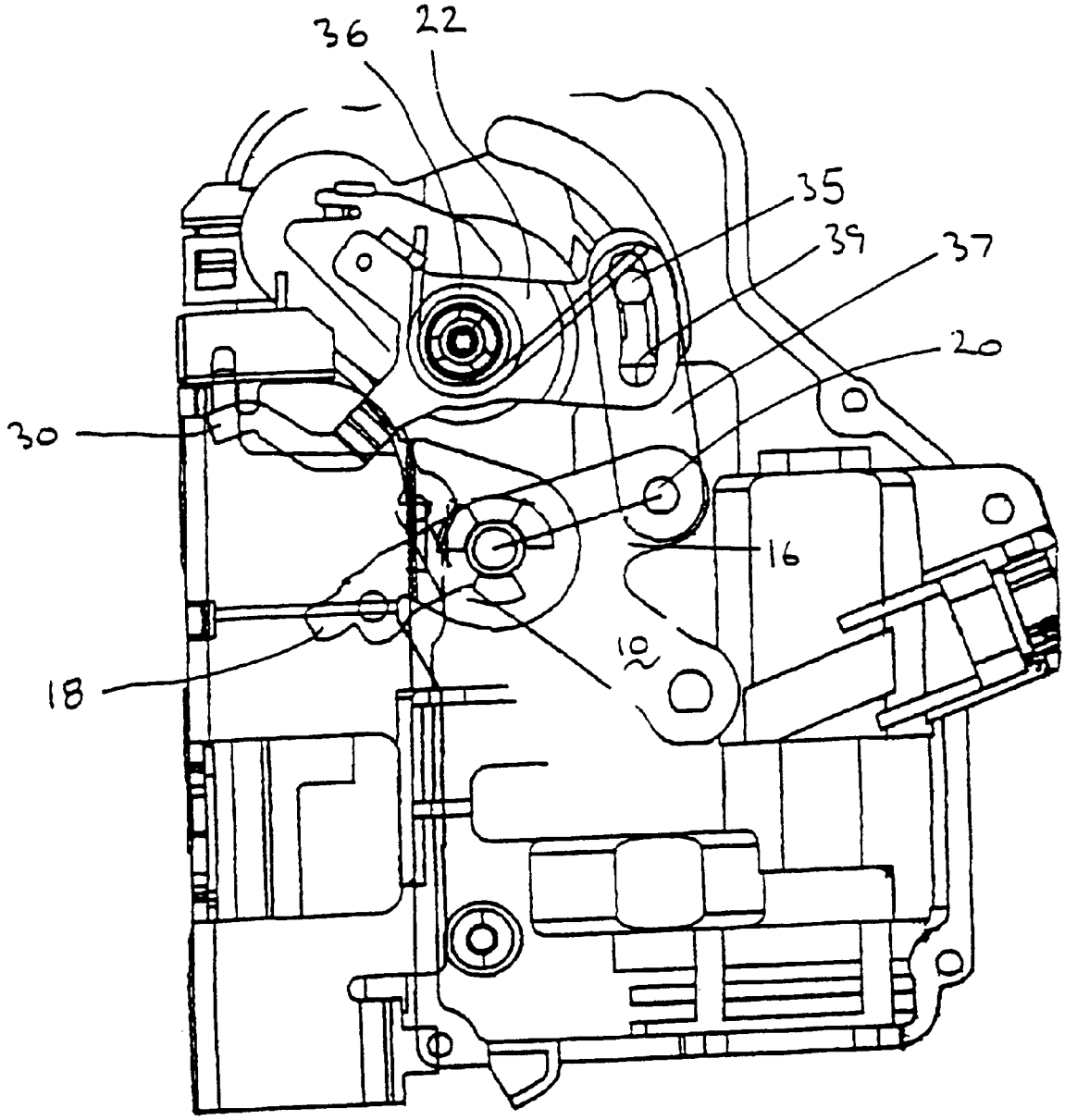
FIG. 3 illustrates a side elevation of a first embodiment of the mechanism of the present invention in an unlocked/unlatched condition.

Referring firstly to FIGS. 1 to 3, the embodiment there shown in part is a vehicle door locking and latching mechanism.

Self-acting latching means includes a rotating claw or other latch co-acting with a bolt or striker on the door post in use and retained in fully closed and first safety conditions by, in the case of the claw, a co-acting pawl. The pawl is linked in turn to a latch release member, in this example a release lever 10 having a fulcrum pivot at 12. One arm 14 of lever 10 is linked to a manually operable interior handle of the door.

A second arm 16 includes a formation in the form of a first pin 20.

A third arm 18 acts to release the above mentioned pawl.

The locking means of the mechanism includes a bell crank lock drive lever 22 fulcrumed about a pivot axis 24 in spaced parallel relationship to axis 12.

Lever 22 is angularly displaceable between locked and unlocked positions determined respectively by fixed upper and lower stops which are abutted by opposite sides of a first arm 30 of lever 22 (see FIGS. 1 and 2 respectively).

First arm 30 operates to effect locking and unlocking of the door in a manner well known in the art.

A second arm 32 of said lever 22 has a slot 34 through which a second pin 35 extends. Second pin 35 is mounted on link 37, the lower end of which is pivoted on the first pin 20. It can be seen that the lower edge 39 of slot 34 forms a formation which co-acts with first pin 20 via link 37 to limit travel of release lever 10, clockwise as viewed in the drawings, but permitting substantial movement of lever 10 in the opposition direction relative to lever 22.

A helically wound wire torsion spring 36 is located around pivot axis 24, bearing at one end against stop 41 on lever 22 and at the other end against second pin 35, so as to resiliently urge second pin 35 towards edge 39 of slot 34.

Drive lever 22 is provided with an over center spring which urges it into abutment with one of the stops 26, 28 once it has passed over center between them so that the locking means will not be displaced from a locked or unlocked condition until appreciable operating force is applied.

The sequence of operation of the above mechanism is as follows:

In FIG. 1 release lever 10 has been shifted by means of inside door handle to its extreme clockwise position as viewed in the drawings, this being its door secure position. Its movement in this direction draws lock drive lever 22 positively to its locked position against upper stop 26 by first pin 20 acting on link 37 to engage second pin 35 with edge 39 of slot 34. This leaves the door latched and locked.

FIG. 2 shows release lever 10 shifted counter-clockwise to an intermediate neutral position. This effects unlocking, but not unlatching of the door, as the movement of link 37 substantially vertically upwards causes torsion spring 36 to drive lever 22 counter-clockwise via stop 41. The spring is strong enough to overcome the retaining force of the over-center spring, allowing arm 30 of lever 22 to move until it abuts the lower stop 28.

To open the door the inside handle is used to shift release lever 10 to its extreme counter-clockwise position shown in FIG. 3 which will free the pawl from the claw allowing the door to unlatch for opening. This motion of lever 10 is reacted against by spring 36, while the second pin 35 moves through slot 34 and the lock drive lever 22 therefore remains undisturbed against stop 28. Once unlatched the interior door handle will be released and spring 36 urges or assists in urging lever 10 back as far as its neutral position, as illustrated in FIG. 2.

As there is no separate sill button or equivalent for effecting manual locking and unlocking of the door from the inside of the vehicle, only one linking connection to lever 10 is needed from the single interior door handle for effecting both functions with considerable simplification in production and assembly.

Furthermore, the interior door handle is usually remote from the vulnerable window opening of the door unlike the conventional sill button which may be accessed by "fishing" if the window is left, or is forced, slightly open. The door handle can be positioned, eg in a door recess and shaped for maximum deterrence of tampering from the vehicle exterior.

Figure 6:
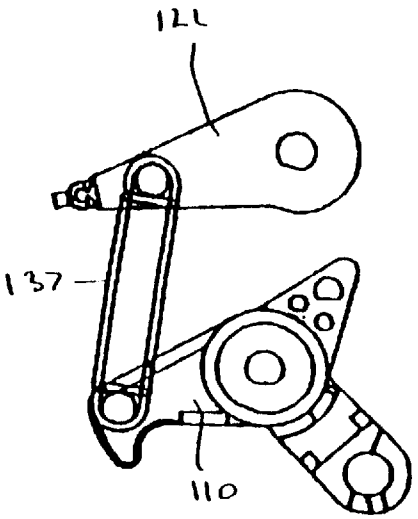
FIG. 6 illustrates a side elevation of a second embodiment of the mechanism of the present invention in an unlocked/unlatched condition.
Figure 5:
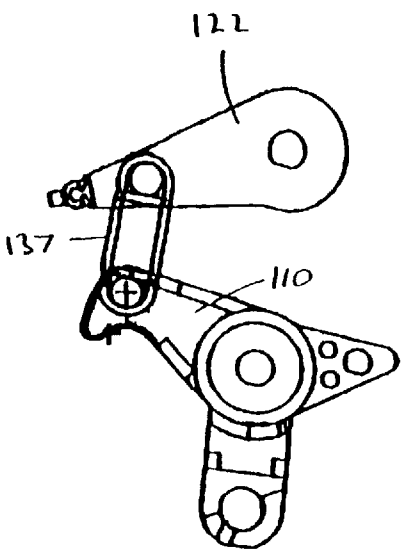
FIG. 5 illustrates a side elevation of a second embodiment of the mechanism of the present invention in an unlocked/latched condition.
Figure 4:
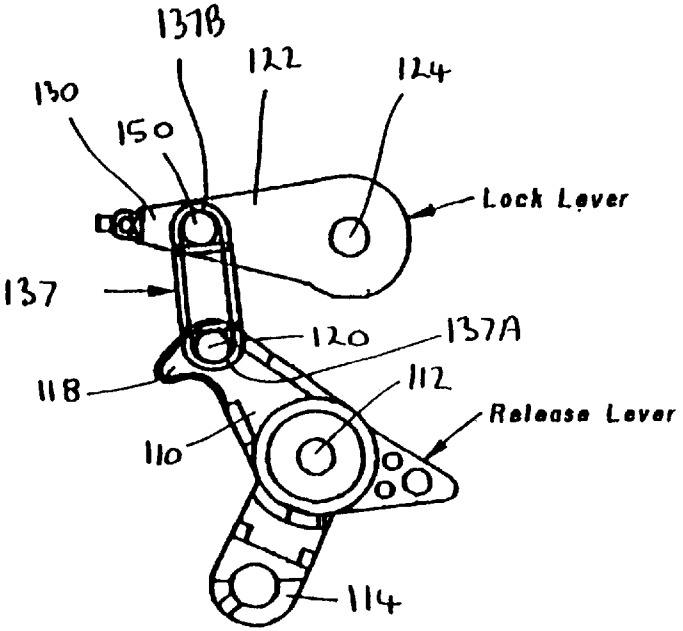
FIG. 4 illustrates a side elevation of a second embodiment of the mechanism of the present invention in a locked/latched condition.

FIGS. 4, 5 and 6 illustrate a second embodiment of the invention in which the arrangement and action of most of the operating parts of the mechanism and their mounting in the door are not shown for clarity.

Latch release lever 110 has a fulcrum pivot at 112. One arm 114 of lever 110 is linked to manually operable interior door handle of the door. A further arm 118 acts to release a pawl and claw mechanism. Arm 118 further includes a formation in the form of a first pin 120.

A locking means of the mechanism includes a lock drive lever 122 fulcrumed about a pivot axis 124 in spaced parallel relationship to axis 112.

Lever 122 is angularly displaceable between locked and unlocked positions determined respectively by fixed upper and lower stops which are abutted by opposite sides of arm 130 of lever 122.

Arm 130 operates to effect locking and unlocking of the door in a manner well known in the art.

Arm 130 includes a formation in the form of a second pin 150 which co-acts with first pin 120 via spring 137 to restrict travel of release lever 110 clockwise as viewed in the drawings, but to permit substantial movement of lever 110 in the opposite direction relative to lever 122.

Drive lever 122 is provided with an over center spring which urges it into abutment with one or other of the upper and lower stops once it has passed over center between them so that the locking means will not be displaced from the locked or unlocked condition until appreciable operating force is applied.

Spring 137 includes end hooks 137A, 137B which engage first pin 120 and second pin 150 respectively. Spring 137 is in a coil bound condition as shown in FIGS. 4 and 5 and in an extended position as shown in FIG. 6. The term coil bound refers to a tension or compression spring in which successive coils of the spring contact each other.

The sequence of operation of the above mechanism is as follows:

In FIG. 4 release lever 110 has been shifted by means of inside door handle to its extreme clockwise position as viewed in the drawings, this being its door secure position. Its movement in this direction causes spring 137 to push lock lever 122 to its locked position against its upper stop. This leaves the door latched and locked.

FIG. 5 shows release lever 110 shifted counter-clockwise to an intermediate neutral position. This effects unlocking, but not unlatching of the door as the movement of pin 120 substantially vertically downwards causes spring 137 to pull lever 122 counter-clockwise to its unlocked position, spring 137 being strong enough to overcome the retaining force of the over center spring, allowing arm 130 of lever 122 to move until it abuts the lower stop (not shown).

To open the door the inside handle is used to shift release lever 110 to its extreme counter-clockwise position shown in FIG. 6 which will free the pawl from the claw allowing the door to unlatch for opening. This motion of lever 110 cause extension of spring 137 whilst the lever 122 remains undisturbed against its lower stop. Once unlatched the interior door handle will be released and spring 137 will return to the position as shown in FIG. 5.

In particular it is not necessary that spring 137 is coil bound when in the position as shown in FIGS. 4 or 5. The mechanism will function correctly provided the following two conditions are met:

a) When release lever 110 is moved from its position as shown in FIG. 4 to the position of FIG. 5 the tension in spring 137 is sufficient to overcome the over center spring on lever 122 resulting in lever 122 moving from the position as shown in FIG. 4 to the position as shown in FIG. 5.

b) When lever 110 moves from the position shown FIG. 5 to the position shown in FIG. 4 the compressive forces in spring 137 are sufficient to overcome the over center spring on lever 122 and move lever 122 from the position as shown in FIG. 5 to the position as shown in FIG. 4.

It can be particularly advantageous that spring 137 becomes coil bound at some stage during locking of the door, though as stated above the spring need not necessarily be coil bound when the door is in the locked and latched position or alternatively when the door is in the unlocked and latched condition.

Advantageously it can be seen that pins 120 and 150 and spring 137 of the second embodiment fulfil the function of pins 20 and 35 slot 34 and spring 36 of the first embodiment. Thus these components of the second embodiment are fewer in number and easier to manufacture than the equivalent components of the first embodiment.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A door latching and locking mechanism comprising:

a latch release member operatively able to hold a door closed having a path of travel extending between a door secure position and a release position and being selectively moveable from an intermediate neutral position to said release position to open said door;

a lock drive member selectively moveable between a locked position and an unlocked position acting to secure said door by preventing release actuation of said latch release member;

a motion transmitter to couple said latch release member and said lock drive member including a first formation on one of said members co-acting with a second formation on the other of said members by a connector to shift said lock drive member to said locked position on movement of said latch release member from said neutral position to said door secure position; and a resilient member acting between said latch release member and said lock drive member to ensure said lock drive member returns to said unlocked position on return movement of said latch release member from said door secure position to or beyond said neutral position and permitting travel of said latch release member to said release position but urging said latch release member from said release position to said neutral position.

2. The door mechanism as recited in claim 1 wherein said connector is a link.

3. The door mechanism as recited in claim 2 wherein said link is pivotally mounted on said latch release member.

4. The door mechanism as recited in claim 2 wherein a lost motion connection exists between said link and said lock drive member.

5. The door mechanism as recited in claim 2 wherein said resilient member biases said link into engagement with said first formation and said second formation.

6. The door mechanism as recited in claim 5 wherein said resilient member is mounted on said lock drive member.

7. The door mechanism as recited in claim 1 wherein said connector is said resilient means.

8. The door mechanism as recited in claim 7 wherein said resilient member acts in compression and tension during a cycle of moving said lock drive member from said locked position to said unlocked position and back to said locked position.

9. The door mechanism as recited in claim 7 wherein said resilient member is arranged to reach a state of maximum compression during at least part of the operation of said locking mechanism.

10. The door mechanism as recited in claim 7 wherein said resilient member is a helically wound spring.

11. The door mechanism as recited in claim 10 wherein said helically wound spring becomes coil-bound during at least part of the cycle.

12. The door mechanism as recited in claim 1 wherein both said release member and said lock drive member are levers fulcrumed for movement about parallel axes.

13. The door mechanism as recited in claim 1 wherein both said release member and said lock drive member are levers fulcrumed for movement about a common axis.

* * * * *